US005421502A

United States Patent [19]

Huang

[11] Patent Number: 5,421,502

[45] Date of Patent: Jun. 6, 1995

[54] STAPLER

[76] Inventor: Bao-Ruh Huang, No. 136, Tzu Chiang Rd., Chang Hwa City, Taiwan, Prov. of China

[21] Appl. No.: 286,545

[22] Filed: Aug. 5, 1994

[51] Int. Cl.[6] ..... B25C 5/11

[52] U.S. Cl. ..... 227/134

[58] Field of Search ..... 227/134

[56] References Cited

U.S. PATENT DOCUMENTS

| | | | |
|---|---|---|---|
| 2,420,830 | 5/1947 | Maynard | 227/134 |
| 2,726,393 | 12/1955 | Vogel | 227/134 |
| 2,798,219 | 7/1957 | Maynard | 227/134 |
| 3,083,367 | 4/1963 | Ruskin | 227/134 |
| 3,144,653 | 8/1964 | Kohen | 227/134 |
| 5,263,628 | 11/1993 | Huang | 227/134 |

*Primary Examiner*—Scott A. Smith
*Attorney, Agent, or Firm*—William E. Pelton

[57] ABSTRACT

A stapler includes a base, a pusher, a main plate, a handle plate and a handle. The handle plate has two hook elements defining a slit and a U-shaped second spring engaged between said two hook elements to urge them apart to engage to an ejector. The main plate is received in the pusher and has a projection extending downward therefrom to insert into a hole defined in a bottom of the pusher so as to define a slot between the main plate and the pusher in one end.

4 Claims, 5 Drawing Sheets

STAPLER

BACKGROUND OF THE INVENTION

The present invention relates to a stapler and more particularly, to a stapler having a handle plate which needs no heat treatment and having a feature of maintaining a minimum effective width of a slot for staple passing thereby.

A conventional stapler shown in FIG. 1 and 2 includes a base 80, a pusher 50, a main plate 40, a handle plate 70 and a handle 81. The base 80 has two lugs 82 extending upward from an upper surface of an end thereof for pivotal engagement to the handle 81, the handle plate 70 and the pusher 50 therebetween by a rivet 83. A spring 801 is disposed between the base 80 and the pusher 50. The pusher 50 having a U-shaped cross-section has first and second ends, a front wall 54 is formed at the first end thereof, an opening 541 is defined beside the front wall 54 in a bottom of the pusher 50, and two first catches 51 and a stop 52 extend upward from the bottom thereof. The main plate 40 has first and second ends, two flanges 42 extending downward from both sides thereof and is received in the pusher 50 so as to define a slot 55 between the front wall 54 of the pusher 50 and the first end of the main plate 40 to allow staples to be ejected therethrough. Two second catches 41 corresponding to the first catches 51 extend downward from an under side of the main plate 40, a first spring 53 is disposed between the main plate 40 and the pusher 50 and is restrained between the stop 52 and the second catch 41 such that the slot 55 is adjusted when a staple with larger cross-section passes therethrough by pushing the main plate 40 away from the front wall 54.

The handle plate 70 has first and second ends, the first end thereof has a protrusion 71 projecting therefrom and the handle plate has a second spring 72 disposed between an under side of the handle 81 and the handle plate 70, an ejector 61 has an opening 62 for the protrusion 71 to pass therethrough and its upper end is fixed to the under side of the handle 81 such that the handle plate 70 exerts a downward force to the ejector 61 to keep the ejector 61 maintaining a certain position which ensures the ejector 61 passes through the slot 55 precisely. When a user pushes the handle 81 downward, both the ejector 61 and the handle plate 70 will be push downward to the pusher 50, the handle 81 will press the second spring 72 when the handle plate 70 is stopped by contacting the main plate 40 such that the ejector 61 is pushed continuously into the slot 55 and pushes a staple mounted on the main plate 40 through the slot 55 on an object to be stapled, such as several sheets of paper.

However, the handle plate 70 needs a heat treatment process to harden it and this results in a size change which increases a possibility of the protrusion 71 disengaging from the opening 62 of the ejector 61, and this reduces an accuracy of the ejector 61 passing through the slot 55. Further, the main plate 40 engages to the pusher 50 by an engagement of the first and second catches 51 and 41 and by which the width of the slot 55 is maintained, but wear will occur between the first and second catches 41 and 51 after use for a period of time, namely, the slot 55 may be not wide enough to allow the staple to pass through. Furthermore, the handle 81, the handle plate 70, the pusher 50 and the base 80 are riveted together by the rivet 83, which means all the elements are riveted as one piece and cannot be exchanged if any one of them needs to be.

The present invention intends to provide a stapler having an improved structure to mitigate and/or obviate the above-mentioned problems.

SUMMARY OF THE INVENTION

The present invention provides a stapler which includes a base, a pusher, a main plate, a handle plate and a handle. The handle plate has two hook elements defining a slit and a U-shaped second spring engaged between said two hook elements to urge them apart to engaged to an ejector. The main plate is received in the pusher and has a projection extending downward therefrom to insert into a hole defined in a bottom of the pusher so as to define a slot between the main plate and the pusher in one end.

It is an object of the present invention to provide the handle plate which needs no heat treatment and has a spring disposed therein.

It is another object of the present invention to provide the main plate having a feature of maintaining an effective width of the slot.

It is a further object of the present invention to provide the stapler which has a feature of easy reassembly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
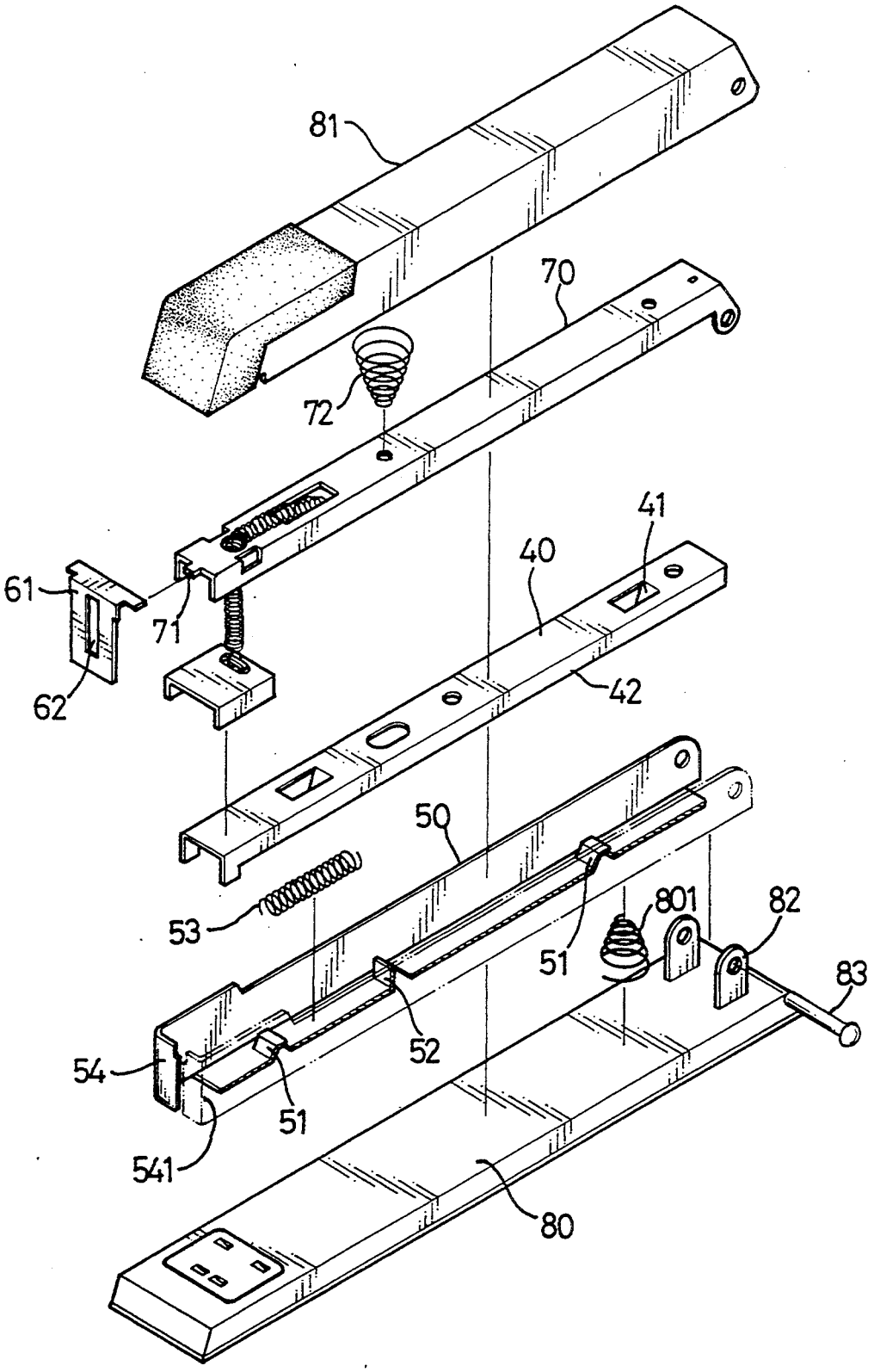
FIG.1 PRIOR ART
FIG. 1 is an exploded view of a conventional stapler.
Figure 2:
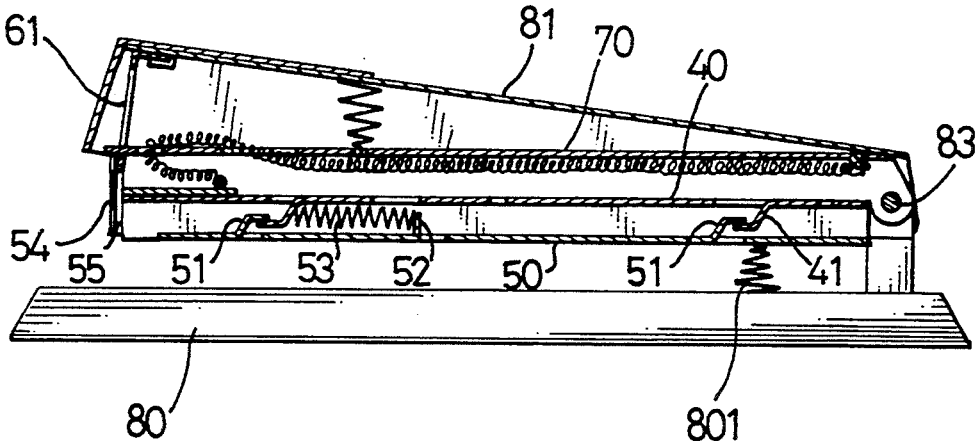
FIG. 2 PRIOR ART
FIG. 2 is a side elevational view, partly in cross-section, of the conventional stapler shown in FIG. 1.
Figure 5:
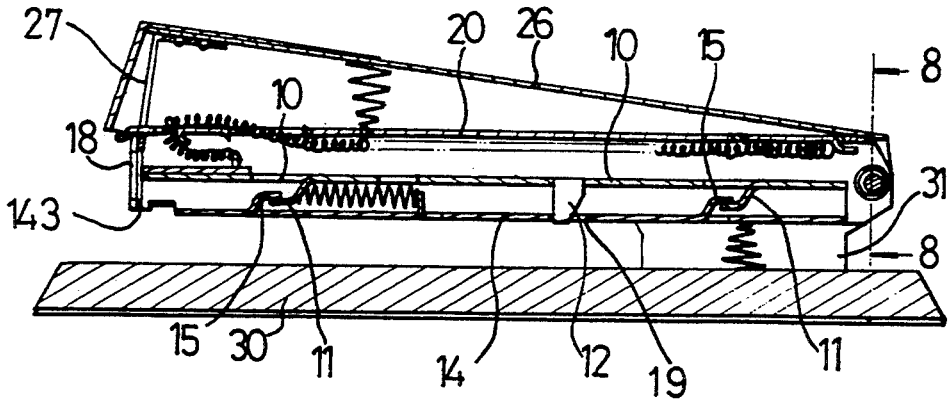
FIG. 5 is a side elevational view, partly in cross-section, of the stapler in accordance with the present invention.
Figure 3:
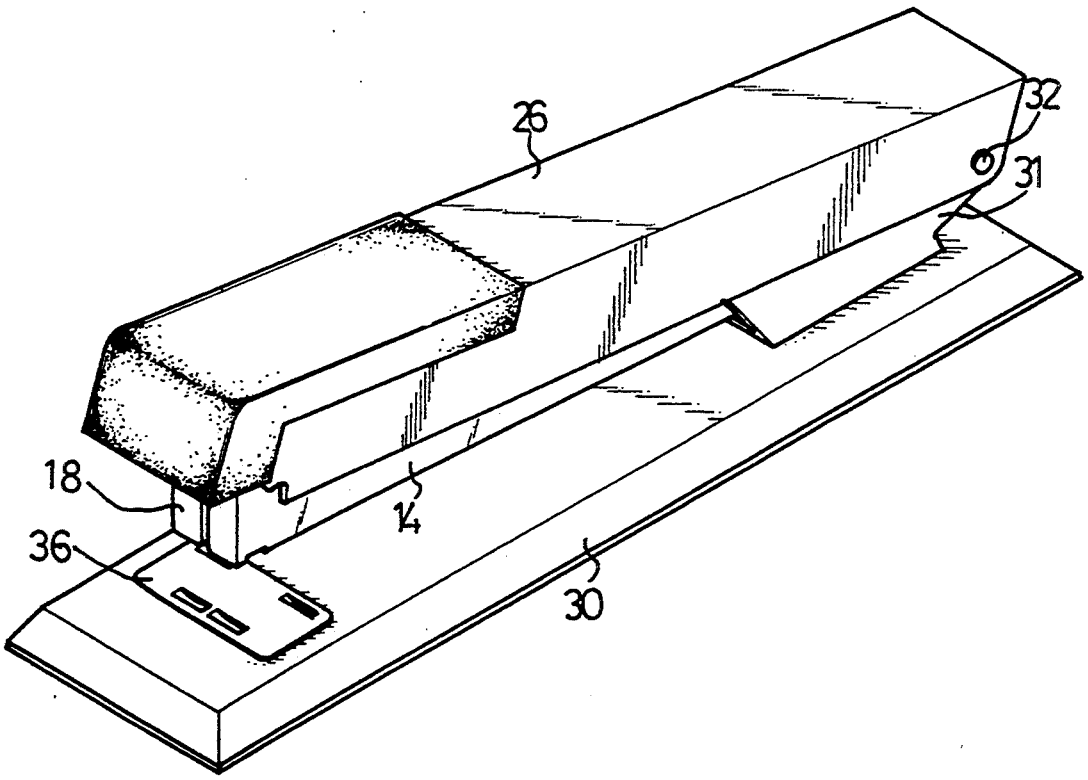
FIG. 3 is a perspective view of a stapler in accordance with the present invention.
Figure 4:
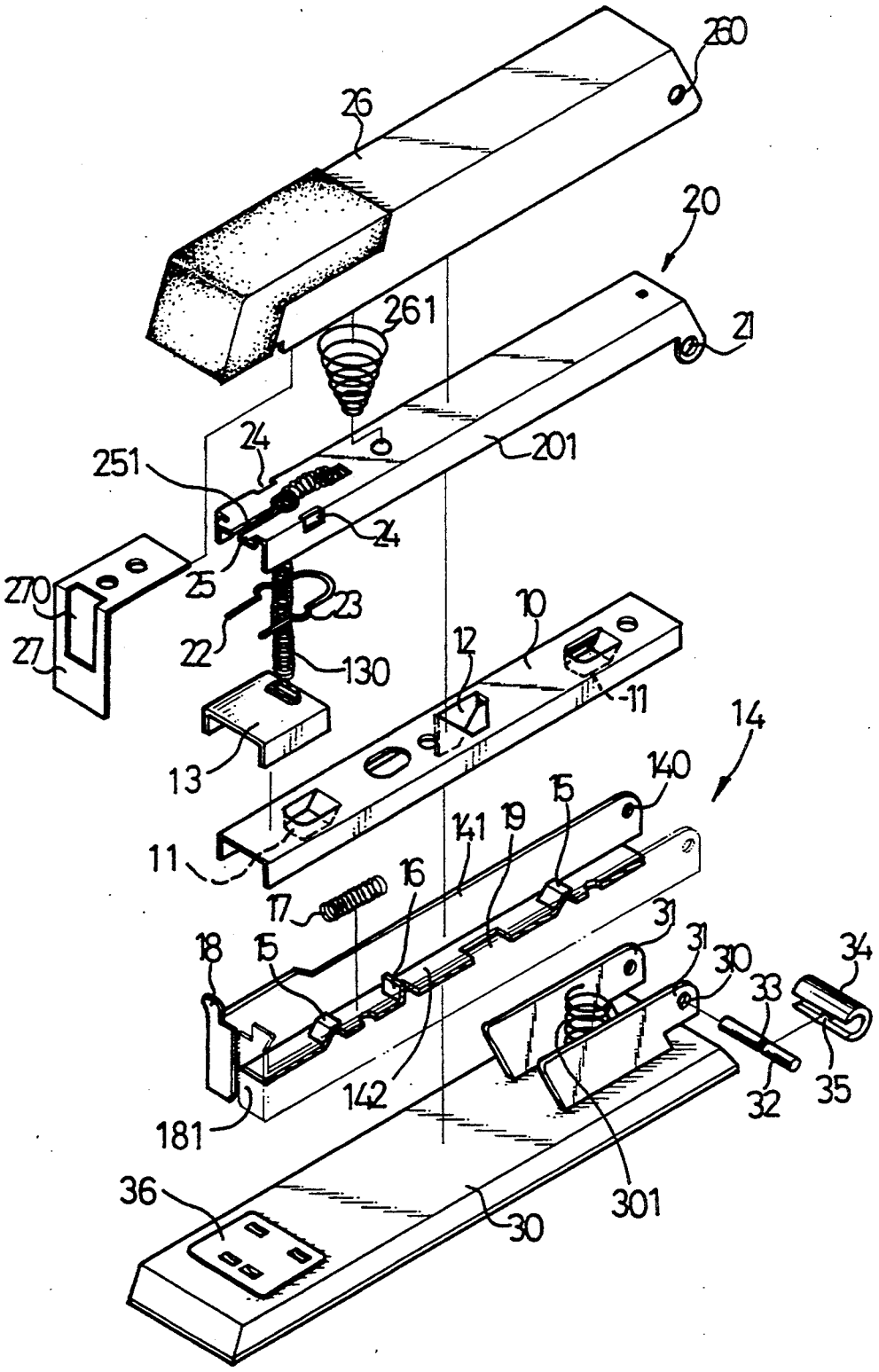
FIG. 4 is an exploded view of the stapler in accordance with the present invention.

Referring to the drawings and initially to FIGS. 3 to 5, a stapler in accordance with the present invention generally includes a base 30, a pusher 14, a main plate 10, a handle plate 20 and a handle 26. The base 30 has first and second ends, the first end thereof having an anvil 36 disposed therein and the second end thereof having two lugs 31 extending therefrom. Each lug 31 has a hole 310 defined near a tip thereof. The pusher 14 having a U-shaped cross section includes two side walls 141 and a bottom 142, and has first and second ends, the first end thereof having a front wall 18 extending vertically, an opening 181 defined beside the front wall 18 in the bottom 142 of the pusher 14, two first catches 15 and a stop 16 extending upward from the bottom 142 of the pusher 14 and a hole 19 defined in the bottom 142, the second end thereof having a hole 140 defined in each side wall 141. A spring 301 is disposed between the second ends of the base 30 and the pusher 14.

Figure 6:
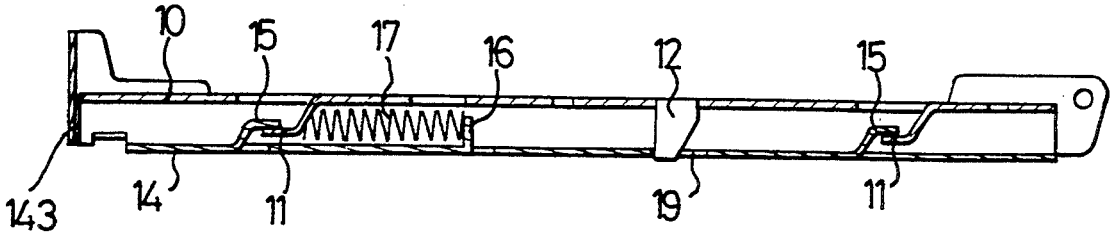
FIG. 6 is a side elevational view, partly in cross-section, of a pusher and a main plate of the stapler in accordance with the present invention.
Figure 7:
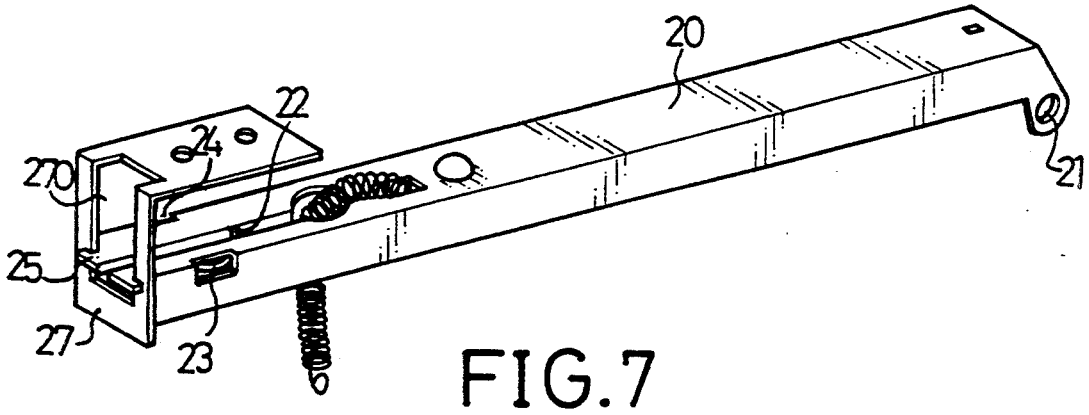
FIG. 7 is a perspective view of a handle plate and an ejector in accordance with the present invention.
Figure 8:
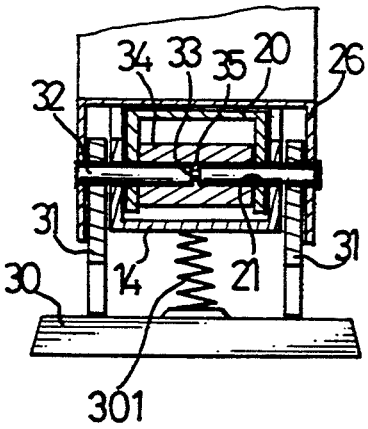
FIG. 8 is a rear end elevational view, partly in cross-section, taken along 8—8 of FIG. 5 of the stapler in accordance with the present invention.

The main plate 10 is received in the pusher 14 and has first and second ends, a slot 143 is defined between the first end thereof and the front wall 18, two second catches 11 extend downward from an under side thereof for engagement to the first catches 15 of the pusher 14. A projection 12 extends downward from the main plate 10 and has a vertical edge towards the first end of the main plate 10, and has an inclined edge towards the second end of the main plate 10 such that the projection 12 can be inserted into the hole 19 of the bottom 142 of the pusher 14 so as to define a certain width of the slot 143 by the vertical edge contacting against a side of the hole 19 (see FIG. 6). A first spring 17 is disposed between the pusher 14 and the main plate 10 and is restricted between the stop 16 and the first catch 15 near the first end of the pusher 14. The handle plate 20 has two side walls 201 and first and second ends, the first end thereof having two hook elements 25 extending horizontally therefrom and a slit 251 defined therebetween, an aperture 24 defined in each of the side walls 201 beside the slit 251, and the second end thereof having a hole 21 defined in each of the side walls 201. A staple pusher 13 used to push staples mounted on the main plate 10 is connected to an end of a spring 130 and its the other end passes through the slit 251 and is engages to an under side of the handle plate 20.

a second spring 22 has a U-shaped configuration and has two protrusions 23 formed on two opposite sides of the U-shaped configuration and the protrusions 23 are inserted into the apertures 24 of the handle plate 20 respectively to urge the two hook elements 25 apart. The handle 26 has two side walls and first and second ends, the second end thereof having a hole 260 defined in each side wall for pivotal engagement to the second ends of the handle plate 20 and the pusher 14 and two lugs 31 of the base 30 by a pin 32 in which is defined a groove 33. Referring to FIG. 8, a cover 34 mounted to the pin 32 is a C-shaped element in which a flange 35 extends from an inner surface thereof to insert into the groove 33 to set a position of the pin 32. Referring to FIG. 4, a third spring 261 is engaged between the handle 26 and the handle plate 20. Referring to FIG. 7, an ejector 27 comprises a horizontal portion and a vertical portion, the horizontal portion is securely engaged to an under side of the first end of the handle 26 and the vertical portion having an opening 270 defined therein for the two hook elements 25 engaged to an edge defining the opening 270.

Accordingly, the stapler in accordance with the present invention has the following benefits:

a. The handle plate 20 needs no heat treatment and is engaged to the ejector 27 by the second spring 22 inserted into the apertures 24 to open the hook elements 25 wide;

b. The slot 143 can be maintained effectively by the vertical edge of the projection 12 contacting against an edge defining the hole 19 of the pusher 14, namely, even if the engagement between the first and second catches 15 and 11 has changed the slot 143 still maintains its allowed minimum effective width; and c. By using the pin 32 and the cover 34, the stapler in accordance with the present invention has a feature of any component being able to be replaced without destroying the stapler as the conventional stapler.

Although the invention has been explained in relation to its preferred embodiment, it is to be understood that many other possible modifications and variations can be made without departing from the spirit and scope of the invention as hereinafter claimed.

I claim:

1. A stapler comprising:

a base having first and second ends, said first end thereof having an anvil disposed therein and said second having two lugs extending therefrom, a hole defined in each said lug;

a pusher having a U-shaped cross section including two side walls and a bottom, and having first and second ends, said first end thereof having a front wall extending vertically, an opening defined beside said front wall in the bottom of said pusher, at least one first catch and a stop extending upward from said bottom of said pusher and a hole defined in said bottom, said second end thereof having a hole defined in each said side wall;

a main plate received in said pusher and having first and second ends, a slot defined between said first end thereof and said front wall, at least one second catch extending downward from an under side thereof for engagement to said at least one first catch of said pusher;

a first spring disposed between said pusher and said main plate and restricted between said stop and said at least one second catch;

a handle plate having two side walls and first and second ends, said first end thereof having two hook elements formed thereto and a slit defined between said two hook elements, an aperture defined in each of said side walls, and said second end thereof having a hole defined in each of said side walls;

a second spring having a U-shaped configuration and having two protrusions formed on two opposite sides of said U-shaped configuration and each said protrusion inserted into one of said apertures of said handle plate;

a handle having two side walls and first and second ends, said second end thereof having a hole defined in each said side wall for pivotal engagement to said second ends of said handle plate, said pusher and two lugs of said base by a pin;

a third spring engaged between said handle and said handle plate; and an ejector composed of a horizontal portion and a vertical portion, said horizontal portion securely engaged to an under side of said first end of said handle and said vertical portion having an opening defined therein for said hook elements engaged thereto.

2. The stapler as claimed in claim 1 wherein said main plate has a projection extending downward from the under side thereof.

3. The stapler as claimed in claim 2 wherein said projection has a vertical edge formed towards an end defining said slot and has an inclined edge formed towards an opposite end.

4. The stapler as claimed in claim 1 wherein said pin has a groove defined therein and a cover mounted to said pin, said cover having a C-shaped configuration and having a flange extending from an inner surface thereof and inserted into said groove.

* * * * *